US005715598A

United States Patent [19]

Everett et al.

[11] Patent Number: 5,715,598

[45] Date of Patent: Feb. 10, 1998

[54] METHOD FOR SEALING A BARE HOLE DEFINED BY A NUCLEAR HEAT EXCHANGER TUBESHEET

[75] Inventors: James W. Everett, Hempfield Township; Pedro C. Olivera, Monroeville; Lawrence A. Nelson, Penn Township, all of Pa.

[73] Assignee: Westinghouse Electric Corporation, Pittsburgh, Pa.

[21] Appl. No.: 572,221

[22] Filed: Dec. 13, 1995

[51] Int. Cl.[6] ..... B23P 15/00

[52] U.S. Cl. ..... 29/890.031; 29/890.03; 29/523; 29/723

[58] Field of Search ..... 29/890.031, 890.03, 29/906, 723, 727; 165/523, 76; 138/89

[56] References Cited

U.S. PATENT DOCUMENTS

| | | | |
|---|---|---|---|
| 3,724,062 | 4/1973 | Cantrell et al. | 29/470.1 |
| 4,390,042 | 6/1983 | Kucherer et al. | 138/89 |
| 4,646,816 | 3/1987 | Rothstein | 29/890.031 |
| 4,829,660 | 5/1989 | Everett et al. | 29/727 |
| 4,986,313 | 1/1991 | Mounet | 138/89 |
| 5,027,507 | 7/1991 | Nelson et al. | 29/890.031 |
| 5,135,705 | 8/1992 | Gooch, IV et al. | 29/890.031 |
| 5,165,470 | 11/1992 | Maekawa et al. | 165/76 |
| 5,167,064 | 12/1992 | Sutor, IV | 29/727 |
| 5,167,907 | 12/1992 | Mauget et al. | 376/260 |
| 5,189,789 | 3/1993 | Hall | 29/890.031 |
| 5,194,214 | 3/1993 | Snyder et al. | 376/203 |
| 5,249,604 | 10/1993 | Keating | 138/89 |
| 5,251,241 | 10/1993 | Moore et al. | 376/204 |
| 5,255,717 | 10/1993 | Nelson et al. | 138/89 |
| 5,479,699 | 1/1996 | Snyder | 29/727 |

*Primary Examiner*—Irene Cuda

[57] ABSTRACT

Method and joint for sealing a bare hole in a nuclear heat exchanger tubesheet. The tubesheet has a plurality of holes formed therethrough, wherein at least one of the holes has been left vacant by a heat transfer tube removed from the hole. Such a hole is defined as a bare hole. One embodiment of the method of the invention comprises disposing a sleeve in the bare hole to protect the tubesheet material from the corrosive attack of the heat exchanger primary coolant and sealingly disposing a sleeve plug in the sleeve in order to seal the sleeve. A leak-tight joint is defined as the sleeve plug is sealingly disposed in the sleeve.

8 Claims, 6 Drawing Sheets

METHOD FOR SEALING A BARE HOLE DEFINED BY A NUCLEAR HEAT EXCHANGER TUBESHEET

BACKGROUND OF THE INVENTION

This invention generally relates to methods of sealing holes and more particularly relates to a method and joint for sealing a bare hole in a nuclear heat exchanger tubesheet, the hole being left vacant (i.e., bare) by a heat transfer tube previously removed from the hole.

In a pressurized water nuclear reactor, heat generated by a nuclear reaction in a reactor core is absorbed by a primary coolant that circulates through the reactor core and that is utilized to generate steam in a steam generator. A transverse tubesheet having holes therethrough divides the steam generator into a primary side below the tubesheet and a secondary side above the tubesheet. Below the tubesheet, a vertical wall (i.e., divider plate) bisects the primary side into an inlet section and an outlet section. An array of thousands of U-shaped heat transfer tubes is disposed in the secondary side of the steam generator. One end of each U-shaped tube is inserted into one of the holes in the tubesheet and communicates with the inlet section of the primary side and the other end each tube is inserted into another hole in the tubesheet and communicates with the outlet section of the primary side.

The heated primary coolant is introduced under pressure into the inlet section of the primary side, circulates through the U-shaped tubes and exits through the outlet section of the primary side. Water introduced into the secondary side of the steam generator circulates around the U-shaped tubes and is transformed into steam by heat given up by the primary coolant. The steam is conveyed to a turbine-generator through a pipe interconnecting the steam generator and the turbine-generator in order to produce electricity in a manner well known in the art.

Occasionally, some of the tubes may degrade and leak. A leaking tube is undesirable because the primary coolant is radioactive and any leakage of reactor coolant into the secondary side of the steam generator will radio-actively contaminate the steam produced by the steam generator. Any tube exhibiting severe degradation is either sleeved at the site of the degradation or plugged to remove the tube from service, so that the primary coolant will not leak into the secondary side. Sometimes, however, the tube may be partially or completely removed and the hole in the tubesheet that is thereby left vacant plugged. A tube is usually removed or pulled to perform visual and destructive examination of a degraded portion of the tube in order to determine the actual extent of any cracking therein. This examination of the pulled tube is used to provide an empirical correlation between the actual condition of a tube and non-destructive eddy-current inspection results of tubes. The hole left vacant by a removed tube is commonly referred to in the art as a "bare hole" and the plug installed in the bare hole is commonly referred to in the art as a "bare hole plug".

The bare hole plug installed in the bare hole of the tubesheet is welded to the tubesheet in order to sealingly secure the bare hole plug in the bare hole. Moreover, the bare hole plug is located at a pressure boundary in the heat exchanger and therefore must be pressure tested to ensure that the bare hole plug will remain in-place even when acted upon by the relatively high pressure (e.g., approximately 2,200 psia) of the primary fluid. However, welding the bare hole plug to the tube-sheet and pressure testing the bare hole plug is a time consuming and costly process and also may undesirably increase radiation exposure to maintenance personnel performing the testing and welding. In addition, applicants have observed that the bare hole plug may itself ultimately leak due, for example, to the effects of primary water stress corrosion cracking. Attempts to repair such leaking bare hole plugs have proven less than completely satisfactory.

A method for controlling leakage through degraded heat exchanger tubes is disclosed in U.S. Pat. No. 5,027,507 titled "Method For Controlling Leakage Through Degraded Heat Exchanger Tubes In The Tubesheet Region Of A Nuclear Generator" issued Jul. 2, 1991 in the name of Lawrence A. Nelson, et al. The method disclosed in the Nelson, et al. patent comprises radially expanding a section of the heat exchanger tube disposed within the bore of the tubesheet into leak resistant engagement with the tubesheet. Although the Nelson, et al. patent discloses a method of controlling leakage through degraded heat exchanger tubes, this patent does not disclose a method and joint for sealing a bare hole in a nuclear heat exchanger tubesheet, the hole being left vacant by a heat transfer tube previously removed from the hole.

Therefore, what is needed is a method and joint for sealing a bare hole in a nuclear heat exchanger tube-sheet, the hole being left vacant by a heat transfer tube previously removed from the hole.

SUMMARY OF THE INVENTION

Disclosed herein is a method and joint for sealing a bare hole in a nuclear heat exchanger tubesheet. The heat exchanger tubesheet has a plurality of holes formed therethrough, wherein at least one of the holes has been left vacant by a heat transfer tube that has been removed from the hole. Such a hole is defined as a "bare hole". One embodiment of the method of the invention comprises disposing a sleeve in the bare hole so as to protect the tubesheet material from the corrosive attack of the heat exchanger primary coolant and then sealingly disposing a sleeve plug in the sleeve in order to seal the sleeve. A leak-tight joint is defined because the sleeve plug is sealingly disposed in the sleeve.

In its broad form the invention is, in a nuclear heat exchanger having a tubesheet disposed therein defining a plurality of holes therethrough for receiving respective ones of a plurality of heat transfer tubes, each of the holes having a side-wall, at least one of the holes being tube-free so as to define a bare hole, a method of sealing the bare hole, comprising the steps of disposing a sleeve in the bare hole and disposing a sleeve plug in the sleeve.

In its broad form the invention is also, in a nuclear heat exchanger having a tubesheet disposed therein defining a plurality of holes therethrough for receiving respective ones of a plurality of heat transfer tubes, each of the holes having a side-wall, at least one of the holes being tube-free so as to define a bare hole, a joint for sealing the bare hole, comprising a sleeve disposed in the bare hole and a sleeve plug disposed in the sleeve.

An object of the present invention is to provide a method and joint for sealing a hole in a nuclear heat exchanger tubesheet, the hole being left vacant by a heat transfer tube previously removed from the hole, which method and joint does not require welding and pressure testing.

A feature of the present invention is the provision of a sleeve sealingly disposed in the bare bole in combination with a sleeve plug sealingly disposed in the sleeve.

An advantage of the invention is that use thereof is less time consuming and less costly and also reduces radiation exposure to maintenance personnel when compared to prior art methods of sealing bare holes in nuclear steam generator tubesheets.

These and other objects, features, and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing out and distinctly claiming the subject matter of the invention, it is believed the invention will be better understood from the following description taken in conjunction with the accompanying drawings wherein:

DESCRIPTION OF THE PREFERRED EMBODIMENTS

Figure 1:
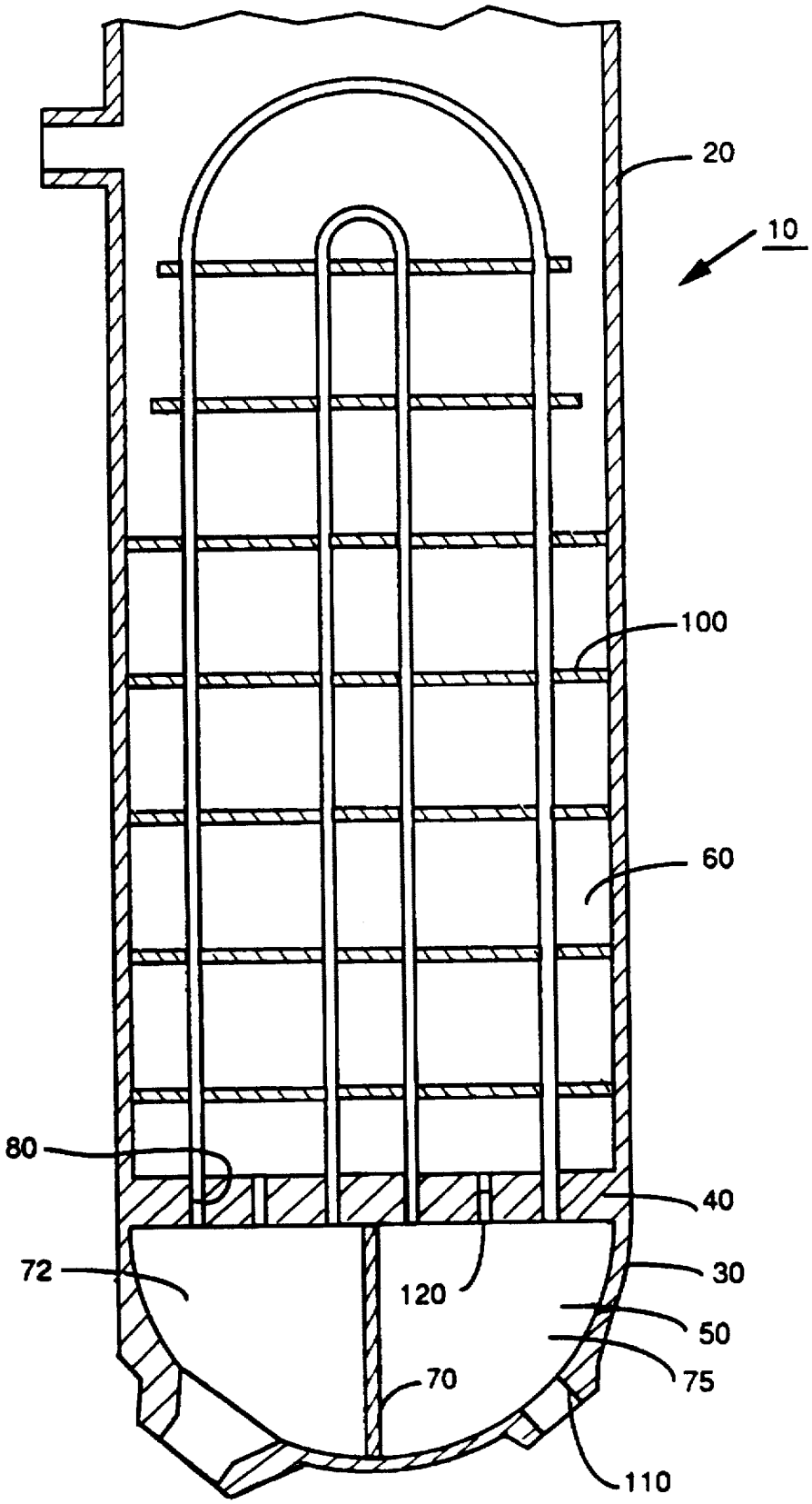
FIG. 1 is a view in partial vertical section of a typical nuclear steam generator with parts removed for clarity, the steam generator having a plurality of heat transfer tubes disposed therein having tube end portions thereof received in respective ones of a plurality of holes formed through a transverse tubesheet disposed in the steam generator, this view showing the tubesheet having at least one bare hole from which a tube end portion has been removed.

Referring to FIG. 1, there is shown a typical nuclear exchanger or steam generator, generally referred to as 10, for generating steam. Steam generator 10 comprises a cylindrical body portion 20 enclosed at its lower end by a hemispherical shell 30. A transverse tubesheet 40 divides steam generator 10 into a primary side 50 below tubesheet 40 and a secondary side 60 above tubesheet 40. Tubesheet 40 may have a layer 65 of cladding material covering the underside surface thereof (see FIG. 2) for protecting tubesheet 40 from corrosive attack by the primary fluid. It is important to protect tubesheet 40 from corrosive attack so that cracks do not form therein. As shown in FIG. 1, the primary side 50 is divided by a divider plate 70 into an inlet section 72 and an outlet section 75.

Still referring to FIG. 1, tubesheet 40 has a plurality of holes 80 therethrough. A plurality of U-shaped heat transfer tubes 90 (only two of which are shown) have ends received in respective ones of the holes 80 so that one end of each tube 90 communicates with inlet section 72 and the other end of each tube 90 communicates with outlet section 75. Each tube 90 is laterally supported on secondary side 60 by a plurality of support plates 100 having holes formed therethrough for passage of each tube 90. A plurality of manways 110 (only one of which is shown) provide access to inlet section 72 and outlet section 75 to allow servicing of steam generator 10 by maintenance personnel. Steam generated by steam generator 10 is transported to a turbine-generator (not shown) through a pipe (not shown) for producing electricity in a manner well known in the art.

Figure 2:
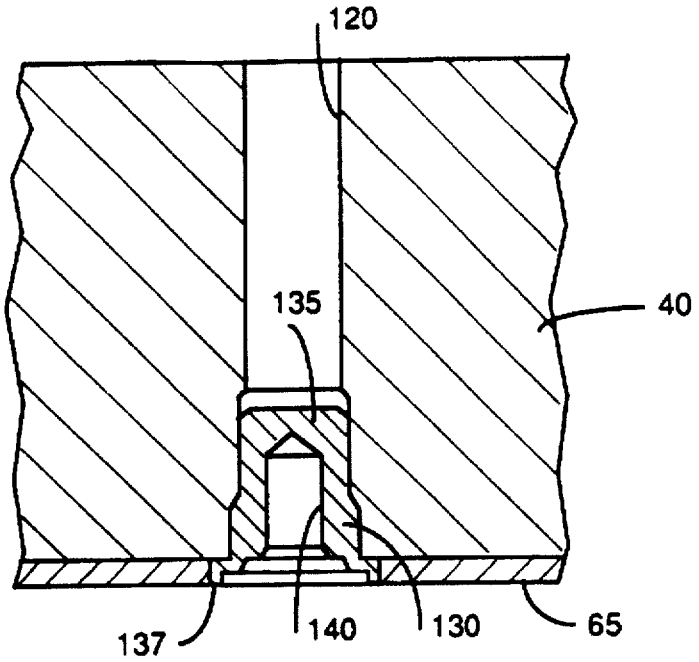
FIG. 2 PRIOR ART
FIG. 2 is a view in vertical section of a prior art bare hole plug disposed in the bare bole.

Referring to FIGS. 1 and 2, at least one of the tubes 90 has been previously removed from one of the holes 80, such as by a suitable tube pulling apparatus (not shown), to define a "bare hole" 120. As shown in FIG. 2, bare hole 120 has been sealed by a prior art bare hole plug 130 sealingly disposed in bare bole 120. In this regard, bare hole plug 130 may have a distal end portion 135 and a proximal end portion 137. Of course, it will be appreciated that the terminology "distal end portion" is defined herein to mean that end portion further away from divider plate 70 and the terminology "proximal end portion" is defined herein to mean that end portion nearer divider plate 70. Prior art bare hole plug 130 is welded to tubesheet 40 after being disposed in bare hole 120 for sealingly affixing bare hole plug 130 in bare hole 120. Moreover, prior art bare hole plug 130 may have a longitudinally disposed blind bore 140 formed therein for receiving a drill bit 150 (see FIG. 3) for reasons described presently.

Figure 3:
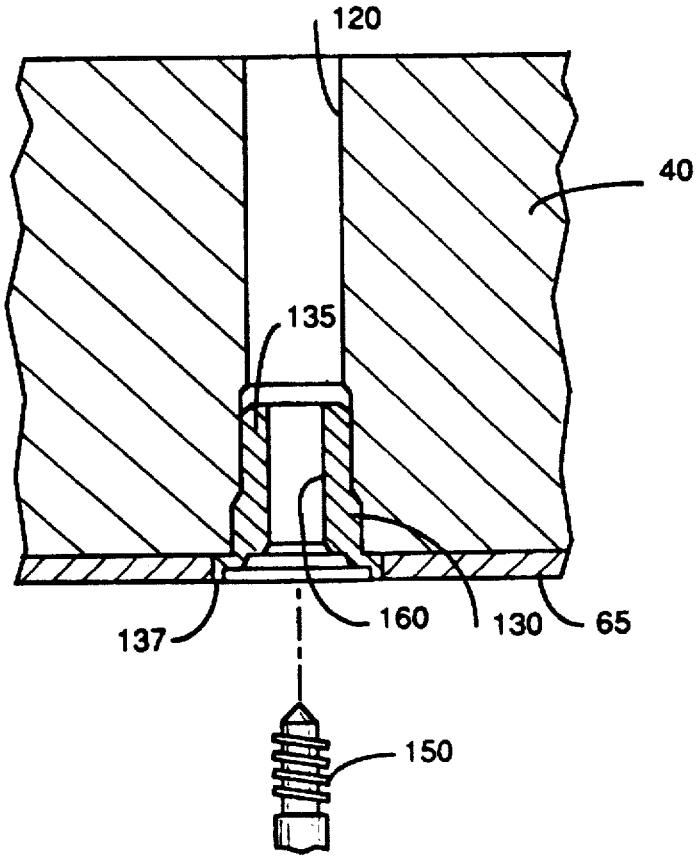
FIG. 3 is a view in vertical section of the prior art plug having a bore drilled therethrough by a drill bit.
Figure 4:
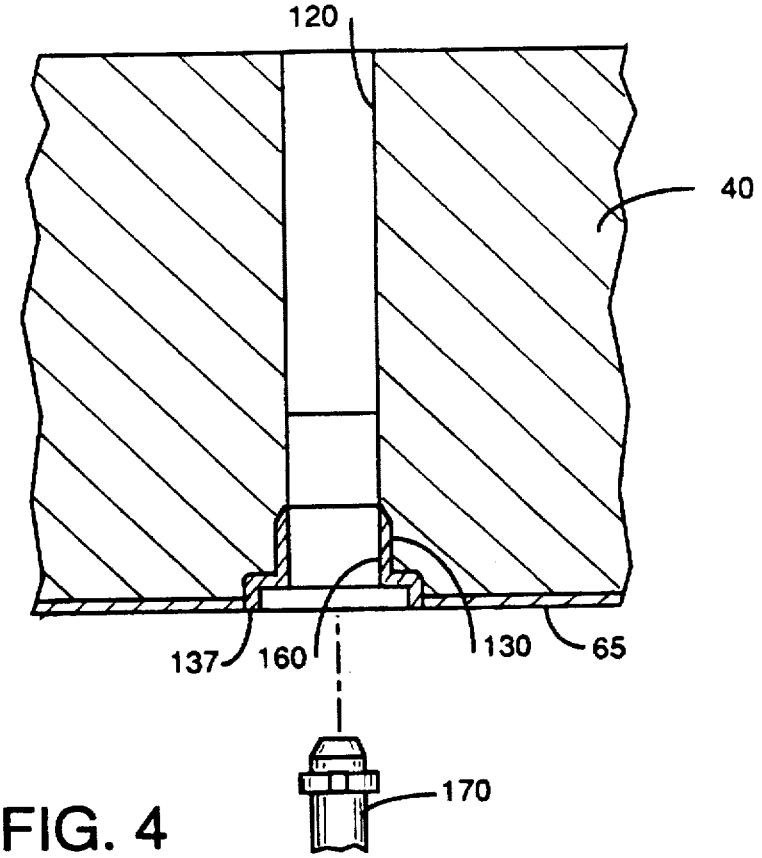
FIG. 4 is a view in vertical section of the prior art plug having the bore drilled therethrough and an upper portion removed therefrom by the drill bit, this view also showing a reamer disposed nearby.

Turning now to FIGS. 3 and 4, drill bit 150 belonging to a drilling apparatus (not shown) is inserted into blind bore 140 and operated to drill a bore 160 through bare hole plug 130 and to remove a portion of distal end portion 135 of bare hole plug 130. Various predetermined diameters of drill bit 150 are used until the diameter of bore 160 is approximately equal to the diameter of bare hole 120. A reamer 170 may be used to remove surface roughness present in bare hole 120 and at the distal end portion of bare hole plug 130.

Figure 5:
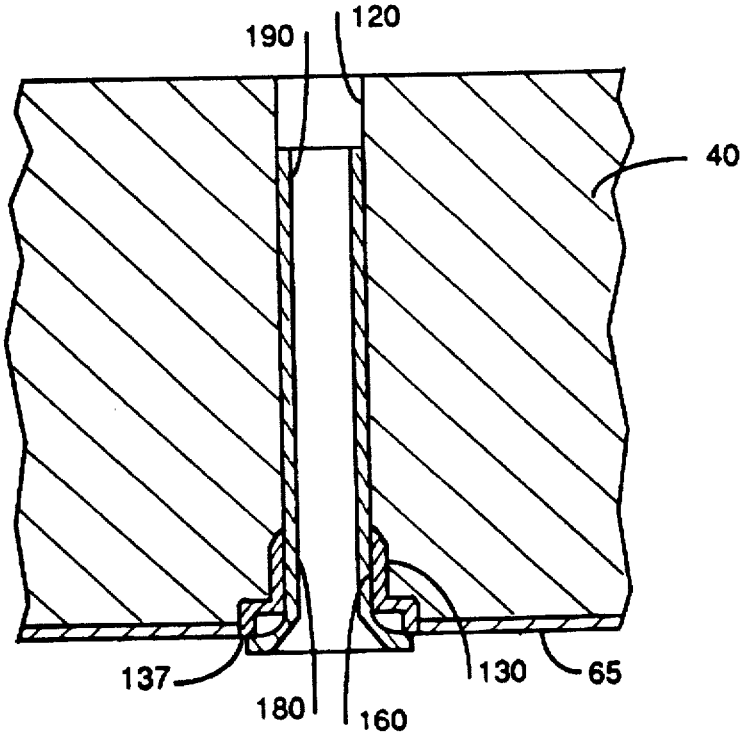
FIG. 5 is a view in vertical section of a sleeve disposed in the bore of the bare hole plug and in the bare hole of the tubesheet.
Figure 5A:
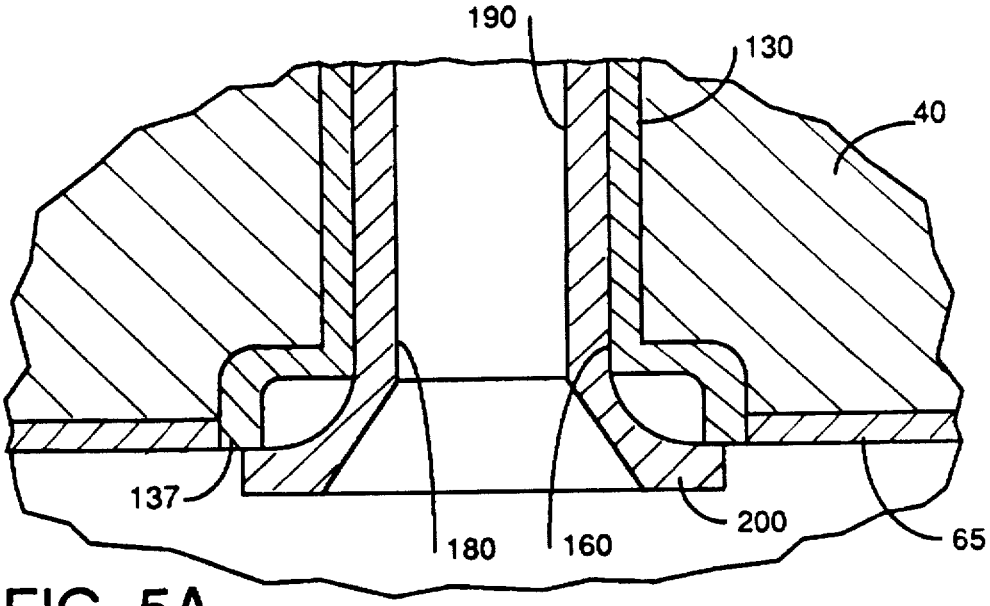
FIG. 5A is a view in vertical section of an end portion of the sleeve.

Referring to FIGS. 5 and 5A, an elongate generally cylindrical thimble, liner or sleeve 180 having a through-bore 190 is disposed in bare hole 120 of tubesheet 40 and bore 160 of bare hole plug 130. In the preferred embodiment of the invention, sleeve 180 has an outwardly flared proximal end portion 200 for sealingly abutting and surrounding proximal end portion 137 of bare hole plug 130. In this manner, primary fluid present in primary side 50 of steam generator 10 will not seep or leak between sleeve 180 and bare hole plug 130 and thereafter travel between sleeve 180 and tubesheet 40 to corrosively attack the unclad portion of tubesheet 40. Sleeve 180 is radially expanded into intimate engagement with bare bole plug 130 such as by a suitable expansion mandrel (not shown). Such an expansion mandrel is disclosed for example in U.S. patent application Ser. No. 08/192,536 titled "Apparatus And Method For Expanding Tubular Members" filed Feb. 7, 1994 in the name of David A. Snyder et al. and assigned to the assignee of the present invention, the disclosure of which is hereby incorporated by reference.

Figure 6:
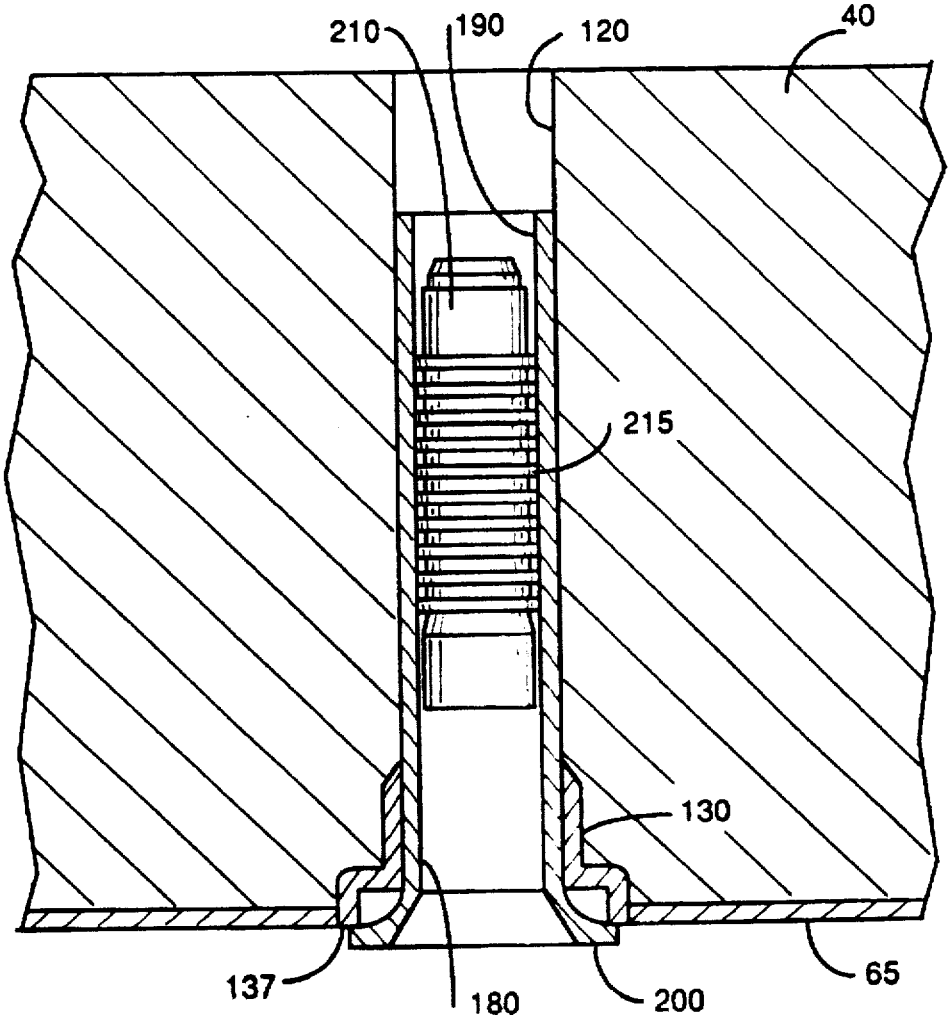
FIG. 6 is a view in partial vertical section of a sleeve plug disposed in the sleeve.

As best seen in FIG. 6, a tapered generally cylindrical sleeve plug 210 is disposed in sleeve 180 for sealing sleeve 180 against intrusion therethrough of the primary fluid. It is important to seal sleeve 180. This is important in order to preclude mixing the radioactive primary fluid with the nonradioactive secondary fluid. Sleeve plug 210 is radially expanded so that a plurality of spaced-apart lands 215 extending circumferentially there-around intimately engage sleeve 180 to seal bore 190 of sleeve 180. It will be appreciated from the description immediately hereinabove that a leak-tight joint is defined when sleeve plug 210 is sealingly disposed in sleeve 180. Sleeve plug 210 may be of the type disclosed in U.S. Pat. No. 4,390,042 titled "Tube Plug" issued Jun. 28, 1983 in the name of Harvey D. Kucherer, et al. and assigned to the assignee of the present invention, the disclosure of which is hereby incorporated by reference.

Figure 7:
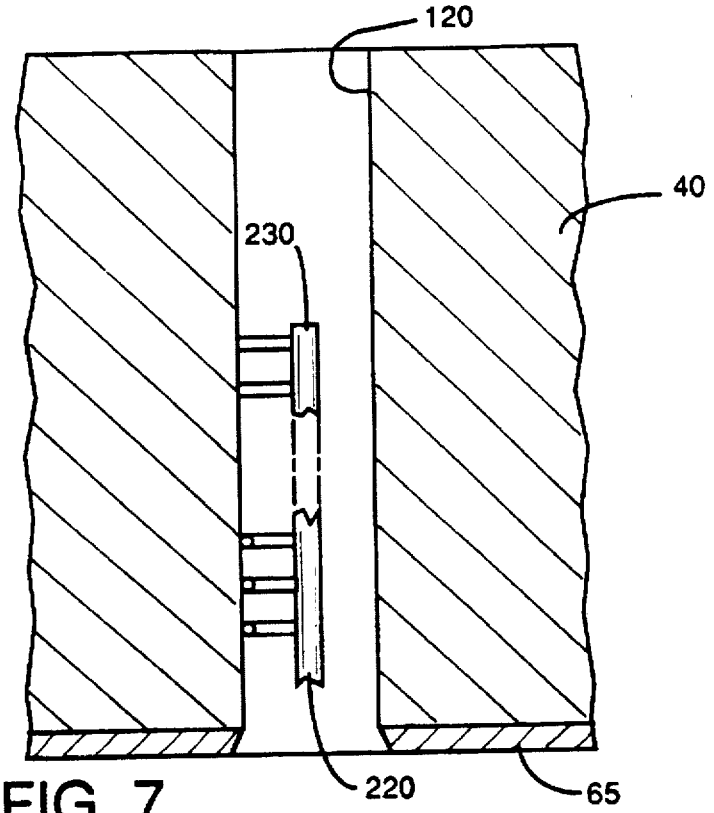
FIG. 7 is a view in elevation of an alternative embodiment of the invention wherein the bare hole is first honed and swabbed prior to disposing the sleeve in the bare hole.
Figure 8:
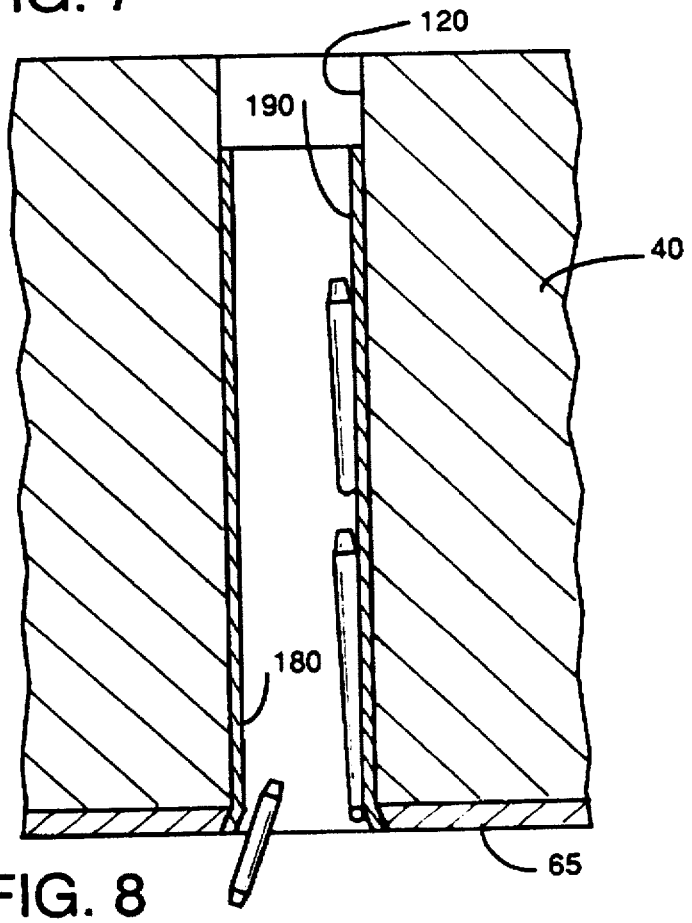
FIG. 8 is a view in elevation of the alternative embodiment of the invention wherein roll expanders are shown expanding the sleeve into intimate engagement with the bare hole.
Figure 9:
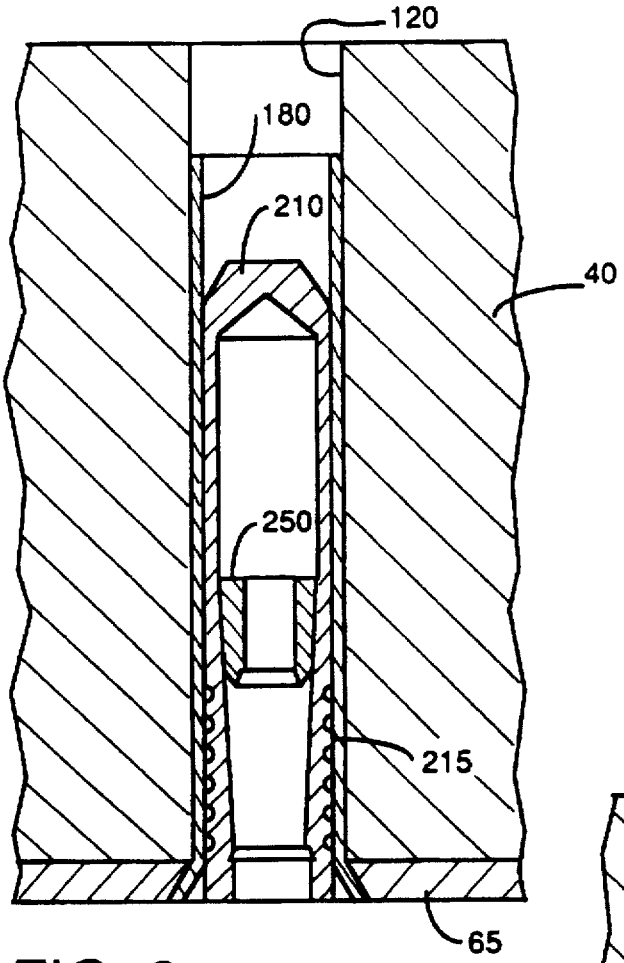
FIG. 9 is a view in vertical section of the alternative embodiment of the invention wherein a sleeve plug is shown disposed in the sleeve.

Referring to FIGS. 7, 8 and 9, another embodiment of the invention is there shown for sealing bare hole 120. In this alternative embodiment of the invention, bare hole 120 does not have prior art bare hole plug 130 because bare hole plug 130 was either never disposed in bare hole 120 or was disposed in bare hole 120 but previously completely removed therefrom. In this alternative embodiment of the invention, bare bole 120 is first wire brushed or honed by an elongate cleaning device 220 rotatable about its longitudinal axis and contacting the wall of bare hole 120 for removing foreign matter (e.g., water, scale, oxide, or the like) from the wall of bare hole 120. Next, the wall of bare hole 120 is swabbed by an elongate swabbing tool 230 rotatable about its longitudinal axis and contacting the wall of bare hole 120 for reasons disclosed presently. In this regard, if bare hole 120 is cleaned with a wire brush (not shown) or honer (not shown), it will be desirable to subsequently clean bare hole 120 with swabbing tool 230. More specifically, the brush or hone will break the scale or deposits present on the wall of bare hole 120, but the brush or hone will not sufficiently remove the scale and deposits from the wall. Swabbing tool 230, which may have a portion thereof soaked in water or a suitable solvent, is therefore used to remove any scale or deposits which may remain on the wall after brushing or honing. Sleeve 180 is then disposed in bare hole 120 and radially expanded to intimately engage the wall of the bare hole 120. Sleeve 180 may be radially expanded by any suitable means used in the art, such as by pneumatic expansion, hydraulic expansion, explosive expansion, or the like or any of these methods in combination with roll expansion. Thus, sleeve 180 may be radially expanded into intimate engagement with the wall of bare hole 120 by the above expansion techniques followed by roll expansion using rollers 240, so that an interference fit is obtained between sleeve 180 and the wall of bare hole 120. Next, sleeve plug 210 is disposed in sleeve 180 and radially expanded for sealing sleeve 180. In this regard, tapered sleeve plug 210 is radially expanded by axially moving an expander member 260 disposed in sleeve plug 210 from the distal end portion to the proximal end portion thereof. As sleeve plug 210 radially expands, lands 215 engage sleeve 180 to seal sleeve 180. It will be appreciated that a leak-tight joint is defined when sleeve plug 210 is sealingly disposed in sleeve 180.

Figure 10:
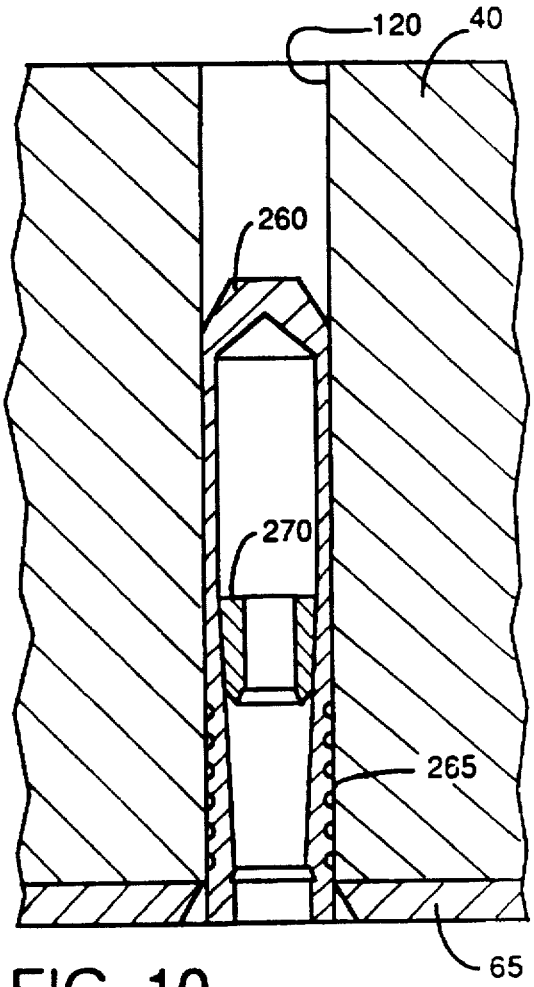
FIG. 10 is a view in vertical section of yet another alternative embodiment of the invention wherein an oversized sleeve plug is disposed in the bare hole, the bare hole not having the sleeve disposed therein.

Referring to FIG. 10, there is shown yet another embodiment of the present invention comprising a tapered "oversized" bare hole plug 260 sized to be sealingly disposed in bare hole 120. Oversized bare hole plug 260 has a plurality of spaced-apart lands 265 extending circumferentially there-around for engaging bare hole 120 to seal bare hole 120. In this regard, lands 265 will sealingly engage the wall of bare hole 120 as tapered oversized bare hole plug 260 radially expands which occurs as expander member 270 is axially moved from the distal end portion of oversized bare hole plug 260 to the proximal end portion of oversized bare hole plug 260. Bare hole plug 260 is "oversized" in the sense that it has a larger outside diameter than the previously mentioned prior art tube plug disclosed in U.S. Pat. No. 4,390,042 issued to Kucherer, et al. Moreover, the oversized bare hole plug 260 serves an important function where tubesheet 40 has cladding 65 on the underside thereof. In this regard, cladding 65 prevents the primary fluid from wetting the material comprising tubesheet 40. When this embodiment of the invention is used, the anchoring and sealing of the bare hole plug 260 occurs in the base material of tubesheet 40 above cladding 65 and therefore prevents wetting of the tubesheet base material over a substantial portion of bore hole 120 because only a relatively small band of tubesheet base material disposed between the lowest of the lands 215 of bare hole plug 260 and cladding 65 is exposed to corrosive attack of the primary fluid. It will be appreciated from the description hereinabove that a leak-tight joint is defined when oversized bare hole plug 260 is sealingly disposed in bare hole 120.

It will be understood from the description hereinabove that an advantage of the present invention is that use thereof reduces radiation exposure to maintenance personnel when compared to prior art methods of sealing bare holes in nuclear steam generator tubesheets because use of the invention makes it unnecessary to perform a time consuming welding operation in the radioactive primary side of the steam generator in order to seal the bare hole.

Although the invention is illustrated and described herein in its preferred embodiment, it is not intended that the invention as illustrated and described be limited to the details shown, because various modifications may be obtained with respect to the invention without departing from the spirit of the invention or the scope of equivalents thereof. For example, the invention is described as suitable for sealing a bare hole in the tubesheet of a nuclear steam generator left vacant by removal of a heat transfer tube; however, the invention is also suitable for sealing a vacant hole formed in any similar structure.

Therefore, what is provided is a method and joint for sealing a bare hole in a nuclear heat exchanger tube-sheet, the hole being left vacant by a heat transfer tube previously removed from the hole.

What is claimed is:

1. In a nuclear heat exchanger having a tubesheet disposed therein defining a plurality of holes therethrough for receiving respective ones of a plurality of heat transfer tubes, each of the holes having a side-wall, at least one of the holes being tube-free so as to define a bare hole, a method of sealing the bare hole, comprising the steps of:

(a) disposing a sleeve in the bare hole; and (b) disposing a sleeve plug in the sleeve.

2. The method of claim 1, wherein said step of disposing a sleeve in the bare hole comprises the step of radially expanding the sleeve into intimate engagement with the wall of the bare hole.

3. The method of claim 1, wherein said step of disposing a sleeve plug in the sleeve comprises the step of radially expanding the sleeve plug into intimate engagement with the sleeve.

4. In a nuclear heat exchanger having a tubesheet disposed therein defining a plurality of round holes therethrough for receiving respective ones of a plurality of cylindrical tube end portions belonging to a plurality of heat transfer tubes, each of the holes having a sidewall, at least one of the holes being free of a tube end portion so as to define a bare hole, a method of sealing the bare hole so that the bare hole is leak-tight, comprising the steps of:

(a) disposing an elongate cylindrical sleeve in the bare hole;

(b) radially expanding the sleeve into intimate engagement with the wall of the bare hole for establishing a seal between the sleeve and the wall of the bare hole by operating an expansion mandrel disposed in the sleeve;

(c) disposing a sleeve plug in the sleeve; and (d) radially expanding the sleeve plug into intimate engagement with the sleeve for establishing a seal between the plug and the sleeve.

5. In a nuclear heat exchanger having a tubesheet disposed therein defining a plurality of holes therethrough for receiving respective ones of a plurality of heat transfer tubes, each of the holes having a side-wall, at least one of the holes being tube-free so as to define a bare hole, the bare hole having a bare hole plug therein, a method of sealing the bare hole, comprising the steps of:

(a) drilling a bore of predetermined diameter axially through the bare hole plug;

(b) disposing a sleeve in the bore of the bare hole plug, the sleeve being sized to matingly fit within the predetermined diameter of the bore; and (c) disposing a sleeve plug in the sleeve.

6. The method of claim 5, wherein said step of disposing a sleeve in the bare hole plug comprises the step of radially expanding the sleeve into intimate engagement with the bare hole plug for establishing a seal between the sleeve and the bare hole plug.

7. The method of claim 6, wherein said step of radially expanding the sleeve into intimate engagement with the bare hole plug comprises the step of operating an expansion mandrel disposed in the sleeve.

8. The method of claim 5, wherein said step of disposing a sleeve plug in the sleeve comprises the step of radially expanding the sleeve plug into intimate engagement with the sleeve for establishing a seal between the sleeve plug and the sleeve.

* * * * *